US007942344B2

(12) United States Patent
Morselli

(10) Patent No.: US 7,942,344 B2
(45) **Date of Patent: *May 17, 2011**

(54) DEVICE AND METHOD TO PREVENT THE EXSICCATION OF FLUID PRODUCTS IN A DISPENSING MACHINE FOR SAID PRODUCTS

(75) Inventor: Emanuele Morselli, Cavezzo (IT)

(73) Assignee: CPS Color Equipment SpA Con Unico Socio, San Felics Sul Panaro (MO) (IT)

( * ) Notice: Subject to any disclaimer, the term of this patent is extended or adjusted under 35 U.S.C. 154(b) by 955 days.

This patent is subject to a terminal disclaimer.

(21) Appl. No.: 11/568,918

(22) PCT Filed: May 10, 2005

(86) PCT No.: PCT/EP2005/052100

§ 371 (c)(1),
(2), (4) Date: Nov. 10, 2006

(87) PCT Pub. No.: WO2005/107956

PCT Pub. Date: Nov. 17, 2005

(65) Prior Publication Data

US 2008/0041428 A1 Feb. 21, 2008

(30) Foreign Application Priority Data

May 11, 2004 (IT) ..... UD2004A0094

(51) Int. Cl.
*F23D 11/34* (2006.01)
*B05B 1/24* (2006.01)
*A47G 19/00* (2006.01)
*B67D 1/08* (2006.01)

(52) U.S. Cl. ..... 239/112; 239/106; 239/135; 222/145.2; 222/148

(58) Field of Classification Search ..... 239/112, 239/132.5, 135–139, 398, 407, 409, 413, 239/416, 417.5, 424, 426, 433, 106, 113; 222/146.4, 148, 145.2
See application file for complete search history.

(56) References Cited

U.S. PATENT DOCUMENTS

| | | | | |
|---|---|---|---|---|
| 3,823,872 | A * | 7/1974 | Frenzl | 239/8 |
| 3,880,354 | A * | 4/1975 | Van Horn | 239/132.3 |
| 4,034,203 | A * | 7/1977 | Cooper | 392/398 |
| 6,202,633 | B1 * | 3/2001 | Campagna et al. | 123/536 |
| 6,227,526 | B1 * | 5/2001 | Morton | 261/115 |
| 6,843,431 | B2 * | 1/2005 | Airaksinen et al. | 239/112 |
| 7,118,820 | B2 * | 10/2006 | Nuttall et al. | 429/413 |

FOREIGN PATENT DOCUMENTS

| | | |
|---|---|---|
| EP | 0669168 A1 | 8/1995 |
| JP | 2001009332 | 1/2001 |
| WO | 02/20175 A1 | 3/2002 |

* cited by examiner

OTHER PUBLICATIONS

PCT Search Report dated Aug. 16, 2005 of Patent Application No. PCT/EP2005/052100 filed_May 10, 2005.

*Primary Examiner* — Dinh Q Nguyen
*Assistant Examiner* — Justin Jonaitis
(74) *Attorney, Agent, or Firm* — Vern Maine & Assoicates

(57) ABSTRACT

A device to prevent the exsiccation of fluid products in a delivery head of a dispensing machine for said fluid products. The device comprises a first element able to generate a flow of air mixed with steam or with at least a solvent, and a second element able to convey the flow towards a zone underneath the delivery nozzles of the delivery head and to create in said zone a determinate atmosphere, different from the atmosphere in the environment where the dispensing machine is to be found during use. The device also comprises detection elements arranged in proximity with the delivery head and able to detect one or more significant parameters of said determinate atmosphere, and a regulation circuit able to regulate one or more characteristics of said flow according to the values detected by the detection elements in order to maintain the significant parameters of the determinate atmosphere within a set of pre-determined values.

12 Claims, 2 Drawing Sheets

DEVICE AND METHOD TO PREVENT THE EXSICCATION OF FLUID PRODUCTS IN A DISPENSING MACHINE FOR SAID PRODUCTS

FIELD OF THE INVENTION

The present invention concerns a device and a method to prevent the exsiccation of fluid products, such as for example coloring liquids, bases for paints, varnishes, enamels, inks and suchlike. The device is able to be advantageously applied in correspondence with the delivery nozzles of a dispensing machine for said products and comprises a cylindrical sleeve inside which a damp air cushion is generated, and maintained at controlled temperature and humidity.

BACKGROUND OF THE INVENTION

Known dispensing or distributing machines for fluid products, such as for example dyes of different shade or color, able to be mixed with each other and/or added to a base substance in order to make up a varnish or a paint of a determinate color, comprise a plurality of delivery nozzles, variable in number, from a few to several dozen units, which are grouped together in a delivery head. Each delivery nozzle is connected to a corresponding tank containing a determinate dye and is governed by pump means which cause the selective delivery of the fluid product in a suitably chosen quantity, for example with the aid of an electronic processor.

Normally, in the use of said dispensing machines, it is necessary to deliver only a few fluid products at a time, and consequently the fluid products, which are not delivered frequently, remain in correspondence with the inactive nozzles and tend to dry out, creating problems when they are required to be delivered.

Moreover, there is also the disadvantage that the exsiccation of the fluid products in correspondence with the respective delivery nozzles leads to mistakes in measuring the quantities delivered, and can determine the introduction of coagulated, unmixable particles into the container that collects the finished product.

In addition, with the present situation in the market of dyes, it is necessary to use, ever more frequently, families of dyes that contain few or no solvents with a high boiling point, the so-called "high-boilers", which generally consist of glycols, for environmental reasons and for reasons of pollution. Parallel to this situation, there has been an ever more frequent increase in the concentration of pigments, so that the fluid products have a high concentration of dry content, imposed by reasons of competition and made possible also by the ability, typical nowadays, of current dispensers to meter, accurately and repeatedly, ever smaller quantities of fluid products.

All this consequently leads fluid products in general, and dyes in particular, to dry out ever more quickly, and requires solutions able to solve this problem.

A mechanical device is known (also called "autocap") applied to a delivery head provided with delivery nozzles and comprising a spongy cap which is able to selectively close the chamber made below the delivery nozzles. To be more exact, when all the nozzles are inactive, the chamber is closed and inside it a saturated or almost saturated environment of solvent and/or steam is formed. On the contrary, when at least one of the fluid products has to be delivered, the chamber is opened so that all the delivery nozzles are exposed to the atmosphere and can be activated. This solution alone is no longer sufficient to prevent exsiccation, because the time the delivery nozzles of the fluid products are exposed during the normal working of a dispenser allows the fluid products exposed, but not involved in the metering, to dry out, thus making it almost impossible to use them when they are subsequently required.

A device is also known to prevent the exsiccation of the delivery nozzles in a dispensing machine, wherein a continuous flow of humidified gas, taken from a tank containing a liquid, is introduced into a zone surrounding the delivery nozzles, by means of a pipe which ends parallel to the latter, as if it were one of them. This solution, however, has a series of problems, the most important of which is the tendency to an excessive concentration of liquid around the nozzles with a consequent saturation of the atmosphere and possible dripping of the fluid products. In other words, to prevent the exsiccation of the fluid products in the delivery nozzles there is a risk of exaggerating in the opposite direction, that is, by excessively fluidizing the fluid products themselves.

It is also known from JP-A-2001-009332 a coating apparatus comprising a plurality of coating material droplets of a coating material able to be diluted with water are attached to the surface of a board. A control system is provided to control the ambient conditions in the periphery of the nozzle tip end as to keep the relative humidity about 70% by supplying water to the ambient atmosphere from a humidifying mechanism on the basis of the sense data from a humidity sensor. Consequently, the coating material able to be diluted with water is prevented from deposition on the nozzle tip end in the dry atmosphere. However, this known apparatus is able to control only the relative humidity in the periphery of the nozzle tip end and to eventually increase the relative humidity by means of the humidifying mechanism, without the possibility to modify the other significant parameters which influence the exsiccation of fluid products.

One purpose of the present invention is to achieve a device and perfect a method to prevent the exsiccation of fluid products which will ensure the efficient and precise functioning of a dispensing machine for said fluid products, also for extended periods of inactivity of the delivery nozzles, preventing the products, in correspondence with the delivery nozzles, from deviating from the conditions of optimum fluidity in which they can be correctly delivered in the desired quantities.

Another purpose of the present invention is to achieve a device which is simple and economical to make and to use.

Another purpose of the present invention is to prevent the exsiccation of fluid products able to be delivered by a dispensing machine for said products possibly without using a protection cap to be arranged in correspondence with the delivery nozzles.

The present Applicant has devised, tested and embodied this invention, which brings a significant technical contribution to the state of the art, in order to obtain these and other purposes.

SUMMARY OF THE INVENTION

The present invention is set forth essentially in claims.

In accordance with the above purpose, a device to prevent the exsiccation of fluid products according to the present invention is able to be applied in a delivery head, provided with one or more delivery nozzles, in a dispensing machine for said fluid products. The device according to the present invention comprises first means able to generate a flow of air mixed with steam and/or with at least a solvent, second means able to convey said flow towards a zone underneath said delivery nozzles and to create in said zone a determinate atmosphere, different from the atmosphere of the environment where said dispensing machine is to be found during use. According to a characteristic of the present invention, the device also comprises detection means, arranged in proximity with the delivery head and able to detect one or more significant parameters of the aforesaid determinate atmosphere, and regulation means able to regulate one or more characteristics of the aforesaid flow of air mixed with steam and/or with at least a solvent, according to the values detected by the detection means in order to maintain the significant parameters of the determinate atmosphere within a set of pre-determined values.

The detection means preferably comprise sensors of a known type, able to detect the conditions of relative humidity (RH %) and temperature (° C.) around the delivery nozzles assembly.

The sensors are connected to a control circuit, for example electronic, which commands the aforesaid first means to generate a flow of air mixed with steam and/or with at least a solvent having pre-determined values of humidity, temperature and/or flow rate, included between lower and upper limit values.

According to another characteristic feature of the present invention, the aforesaid second means comprise a substantially annular distribution chamber arranged at the periphery of the ends of the delivery nozzles, to direct said flow of air mixed with steam and/or with at least a solvent in a substantially angled manner, advantageously orthogonal, to the direction of the outlet flow of the fluid products. In this way the aforesaid determinate atmosphere is generated, which is a kind of cushion of very humid air which, due to its specific weight, less than that of the dry air of the surrounding environment, where the dispensing machine is situated, tends to "float" on the latter and hence to remain constantly in contact with the ends of the delivery nozzles above, thus preventing each fluid product from drying out, without the distribution thereof being compromised.

The detection sensors are advantageously arranged either in the aforesaid circular distribution chamber, in the vicinity of the aforesaid zone below, or inside the latter.

Moreover, by controlling the relative humidity and the temperature, the device according to the present invention is able to prevent the harmful "dew-point" effect, that is, the spontaneous, unwanted and uncontrolled dripping, due to condensation, to which the fluid products could be subjected when in contact with, or immersed in, an excessively humid atmospheres.

According to a variant, the flow of air mixed with steam and/or with at least a solvent can be introduced into the zone immediately below the ends of the delivery nozzles, instead of by means of a circular distribution chamber, by means of central tube arranged between the delivery nozzles or in any case in the head which contains them, and equipped with a suitable terminal deflector, which deflects the air saturated with steam, or other solvent, orthogonally to the direction of flow of the dyes.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

These and other characteristics of the present invention will become apparent from the following description of a form of embodiment, given as a non-restrictive example with reference to the attached drawings wherein.

DETAILED DESCRIPTION

Figure 1:
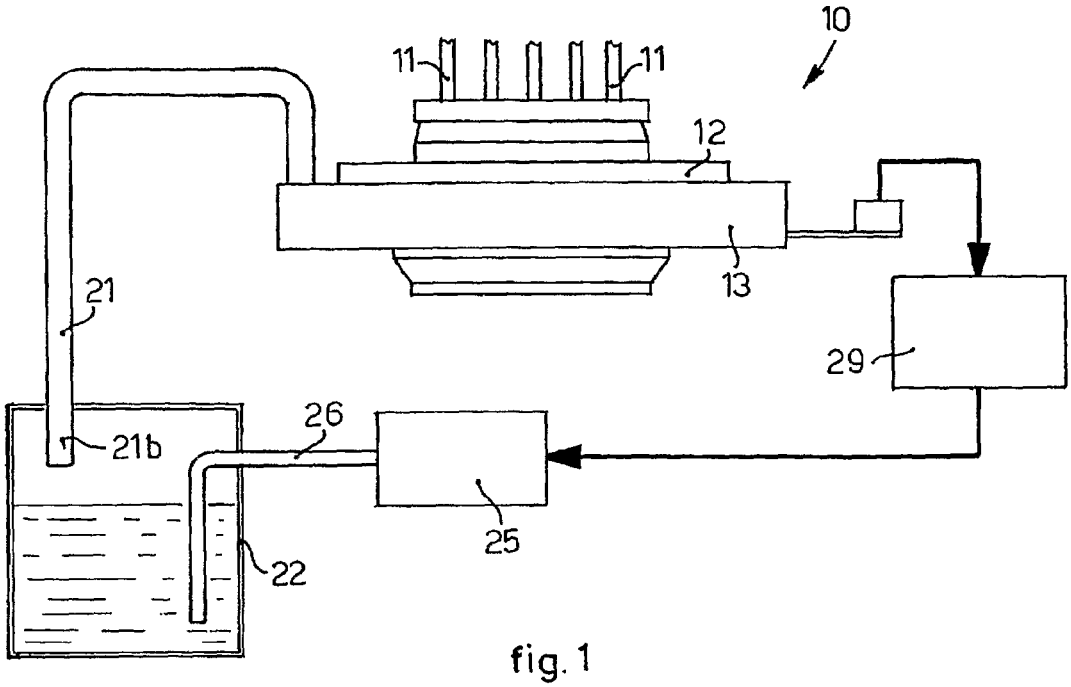
FIG. 1 is a diagram of the device to prevent the exsiccation of fluid products according to the present invention.
Figure 2:
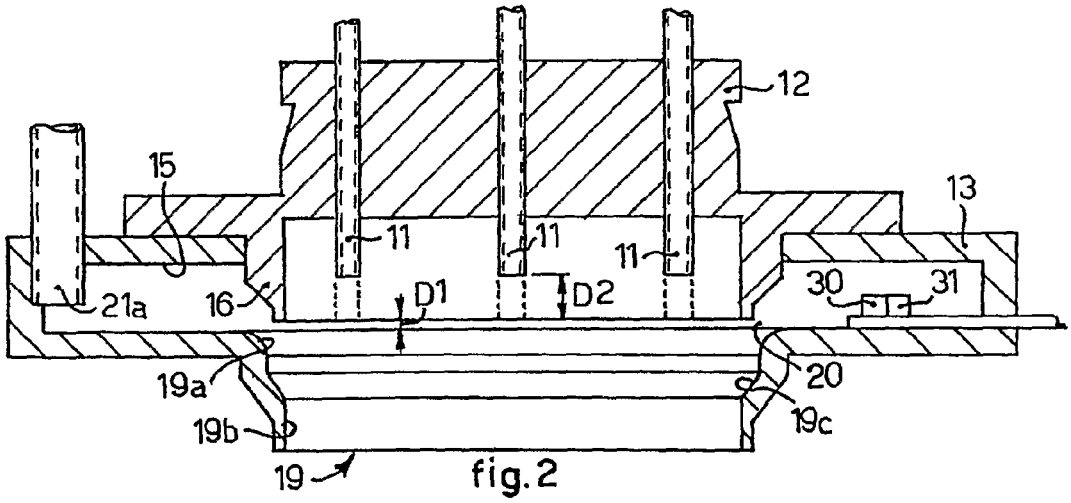
FIG. 2 is an enlarged and sectioned detail of the device in FIG. 1.

With reference to FIGS. 1 and 2, a device 10 according to the present invention to prevent the exsiccation of fluid products in correspondence with the delivery nozzles 11 of a delivery head 12 in a dispensing machine for said fluid products comprises an annular element 13 arranged substantially coaxial with the delivery head 12.

Figure 4:
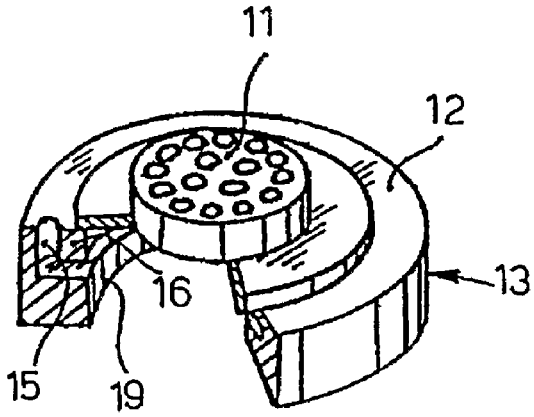
FIG. 4 is a perspective view from above, partly in section, of a detail of FIG. 3.

The annular element 13 is shaped so as to comprise an annular chamber 15 (FIGS. 2 and 4), which extends around the lower end 16 of the delivery head 12, and a compartment 19 arranged below the latter.

The compartment 19 (FIG. 2) is shaped so as to have the three following zones: an upper zone 19*a*, substantially cylindrical and with a diameter greater than the outer diameter of the lower end 16 of the delivery head 12; a lower zone 19*b*, also substantially cylindrical but with a diameter substantially equal to the inner diameter of the said lower end 16; and an intermediate zone 19*c*, flared and connecting the two zones 19*a* and 19*b*.

In this way an annular passage 20 is achieved, some millimeters wide, between the upper zone 19*a* and the lower end 16 of the delivery head 12.

The distance D1 between the base of the annular chamber 15 and the lower end 16 of the delivery head 12 is advantageously between several tenths of a millimeter and one millimeter. The distance D2 between the lower end of each delivery nozzle 11 and the lower end 16 of the delivery head 12, on the contrary, is variable between zero and about 4 mm.

One end 21*a* of a pipe 21 (FIG. 1) is inserted into the annular chamber 15, while the other end 21*b* is inserted into a tank 22, substantially hermetic and in which a liquid is contained, for example water, or a solvent, such as for example a glycol.

A steam generation device 25 is able to introduce steam into the tank 22, by means of a pipe 26, and is connected to a control circuit 29, for example of the electronic type and provided with a microprocessor, which is able to regulate both the quantity and also the temperature of the steam delivered.

The steam generation device 25 can be any known device able to generate; steam, or a mixture of air saturated with steam, into the composition of which a solvent suitable for the fluid products dispensed at least partly enters. For example, for this use heating devices for heating the solvent contained in a tank can be destined. In this case, preferably, the heating devices are connected to the control means in feedback in order to vary the temperature of the steam obtained. It is also possible to use a nebulizer to generate a suspension of solvent particles. In this case, the nebulizer can also have the function of means for introducing the steam. Naturally, these examples are not to be considered restrictive, because they are known devices for generating steam, functioning according to principles that are different from those described here and which equally be adopted by the person of skill in the art who has understood the principles of the present invention.

In the annular chamber 15 (FIG. 2), advantageously in a position diametrically opposite that where the end 21*a* of the pipe 21 is to be found, two sensors 30, 31 are arranged, of a known type, which are able to detect the percentage of relative humidity (RH %) and temperature (° C.) of the fluid present therein and to transmit corresponding electric signals to the control circuit 29 (FIG. 1).

The device 10 as described heretofore functions as follows.

Through the pipe 21, a flow of air mixed with steam and/or with at least a solvent, contained in the tank 22, is introduced into the annular chamber 15. The optimum levels, included between maximum and minimum values, of the significant parameters of the flow, that is to say, those relating to relative humidity and temperature, are pre-determined and obtained by the steam generation device 25 under the control of the circuit 29.

The flow of air mixed with steam and/or with at least a solvent is introduced into the upper zone 19*a* of the compartment 19 through the annular passage 20, in a substantially radial and angled manner, advantageously orthogonal, with respect to the direction of delivery of the fluid products through the delivery nozzles 11. In this way, in the upper zone 19*a*, immediately below the delivery nozzles 11, a determinate atmosphere is created with a humidity rate (RH %) of between about 70% and about 95% and a temperature of between about 10° C. and about 40° C.

If we consider that dry air (for example 20% oxygen—molecular weight 32, and 80% nitrogen—molecular weight 28) is heavier than steam (molecular weight 18), the aforesaid determinate atmosphere tends to rise, because it is lighter, and to remain constantly in contact with the ends of the delivery nozzles 11. In this way the exsiccation of the fluid products present inside each of the latter is prevented.

The sensors 30 and 31 continuously detect the actual values of humidity and temperature and transmit the values in feedback to the control circuit 29, which if necessary modifies the operating conditions of the steam generation device 25 so that the values of the significant parameters are always included between the pre-determined limit values.

The parameters that can be controlled also comprise, for example but not exclusively, physical and chemical characteristics of the air and/or steam present in said upper zone 19*a* and in the surrounding environment, such as the relative or partial pressure. There are many variables on which the control circuit 29 can act in feedback, in order to modify the environmental conditions. Some particularly significant, but not restrictive, examples are temperature, partial pressure, strength, volume and quantity of the solvent introduced, the relative humidity of the mixture of air and steam introduced, the rate of introduction and, in general, one or more physical and/or chemical characteristics of the solvent, steam or mixture of air and steam introduced into the dispensing zone of the group of nozzles 11.

To be more exact, the control circuit 29 controls whether the air around the dispensing zone of the delivery nozzles 11 is saturated or near saturated with steam. If so, the control circuit 29 corrects in feedback the environmental conditions around the delivery nozzles 11, for example raising the temperature or lowering the relative humidity of the steam present in the upper zone 19*a*.

More generally, the control circuit 29 can act on the steam generation device 25 in order to vary the physical and/or chemical characteristics of the steam or air introduced into the annular chamber 15. To be more exact, both the temperature and also the quantity of steam introduced can be increased or decreased, so as to vary, for example, the partial pressure of the steam present in the dispensing zone of the delivery nozzles 11 in order to prevent dew point being reached.

The configuration of the lower part of the annular element 13 has been studied to exploit the characteristics of greater lightness of steam compared with air. The step-like conformation of the lower part of the annular element 13 and its position in contact with the lower end 16 of the delivery head 12 allow to enclose the steam in a limited environment, substantially delimited both above and laterally.

The control circuit 29 can also possibly act in feedback on the steam generation device 25 in order to activate it when another intake of steam is required, or to vary its flow rate. In this case, the consumption caused by the activation of the steam generation device 25 is considerably less than in the case of a continuous and constant feed throughout the period of functioning of the dispensing machine.

Figure 3:
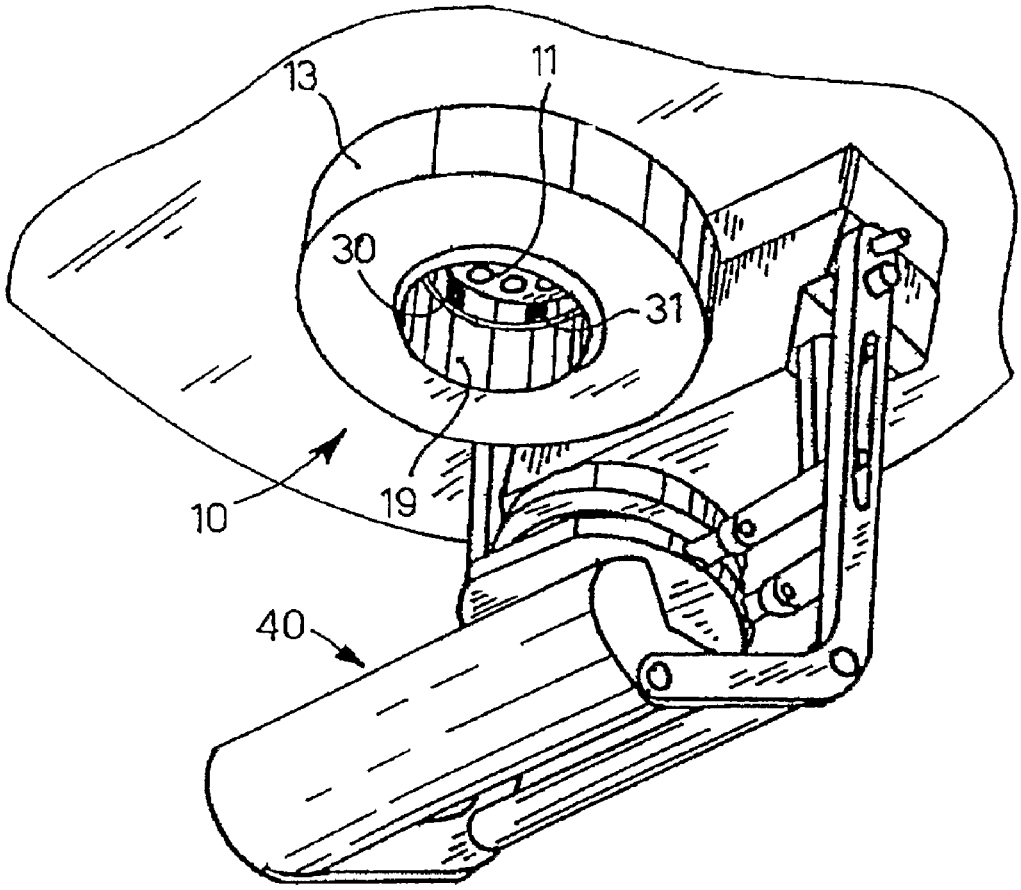
FIG. 3 is a perspective view from below of a part of the device in FIG. 1 applied in a dispensing machine for fluid products.

The provision of the control circuit 29, which can possibly be integrated into the circuitry of the dispensing machine itself, also allows to easily integrate the device 10 with known humidifying systems of the delivery nozzles 11 during the periods of inactivity of the dispensing machine. In fact, it is enough to provide sensor means, of a mechanical, optical, magnetic type or similar, able to detect the inactivity of the dispensing machine and/or the presence or absence in correspondence with the delivery head 12 of a cover device 40 (FIG. 3) for the head, able to create a closed chamber with damp atmosphere, of the known type as mentioned in the preamble to the present description. In these cases, the control circuit 29 is able to completely de-activate the device 10, until the dispensing machine is re-activated for a delivery and/or the cover device 40 of the delivery head 12 is removed.

Moreover, preferably, the sensors 30, 31 can in any case send signals to the control system also during the period of inactivity of the dispensing machine, so as to signal possible anomalies of the cover device 40, when the chamber is closed, of the humidification of the delivery nozzles 11 and possibly cause the activation of alarms and/or automatic corrective operations, for example the topping up of the humidification tank of the cover device 40.

It is clear that modifications and/or additions of parts or steps may be made to the device 10 and the method as described heretofore, without departing from the field and scope of the present invention.

For example, the end 21*a* of the pipe 21 can be arranged in the center of the group of delivery nozzles 11. In this case, a deflector must be suitably associated with the end 21*a* in order to direct the flow of air mixed with steam and/or with at least a solvent in a direction substantially angled and preferably orthogonal with respect to the outlet direction of the fluid products from the group of delivery nozzles 11.

It is also clear that, although the present invention has been described with reference to a specific example, a person of skill in the art shall certainly be able to achieve many other equivalent forms of device or method, having the characteristics as set forth in the following claims and hence all coming within the field of protection defined thereby.

The invention claimed is:

1. A device to prevent the exsiccation of fluid products in a delivery head of a dispensing machine for said fluid products, wherein said delivery head is provided with one or more delivery nozzles, the device comprising:

a ring-shaped element arranged substantially coaxial with said delivery head and shaped so as to define a ring-shaped chamber which extends around said delivery head, said ring-shaped chamber having a central hole which contains at least a portion of said delivery head;

a ring-shaped passage between said ring-shaped chamber and a lower end of said delivery head, said ring-shaped passage surrounding a perimeter of said lower end of said delivery head, said ring-shaped passage providing air communication between said ring-shaped chamber and said lower end of said delivery head;

a flow generation mechanism which is able to generate a flow of air mixed with steam or with at least a solvent;

a conveying apparatus able to convey said flow into said ring-shaped chamber, said flow being further conveyed through said ring-shaped passage to said lower end of said delivery head, thereby creating in a zone underneath said delivery nozzles into which said fluid products are dispensed from said delivery nozzles, a determinate atmosphere, different from the atmosphere in the environment where said dispensing machine is to be found during use;

detection sensors arranged in proximity with said delivery head and able to detect a temperature and a relative humidity or solvent content of said flow; and a regulation mechanism able to regulate the temperature and the relative humidity or solvent content of said flow according to the detected temperature and the detected relative humidity or solvent content in order to maintain the temperature and the relative humidity or solvent content of said flow within a set of pre-determined values.

2. A device as in claim 1, wherein said detection sensors comprise one or more sensors able to detect the conditions of relative humidity and temperature of said determinate atmosphere.

3. A device as in claim 1, wherein said regulation mechanism comprises a control circuit connected to said sensors and able to control the aforesaid flow generation mechanism, in order to generate said flow of air mixed with steam or with at least a solvent having pre-determined values of humidity, temperature, and flow rate within upper and lower limit values.

4. A device as in claim 1, wherein said flow generation mechanism comprises a steam generation device connected to a tank in which a liquid, such as water or a solvent, is contained.

5. A device as in claim 1, wherein said ring-shaped element is shaped so as to also define a compartment which extends below said lower end of said delivery head, and wherein said compartment is divided into three zones arranged one above the other, the three zones being an upper zone, an intermediate zone and a lower zone, the upper zone being substantially cylindrical and having a diameter which is greater than an outer diameter of said lower end of said delivery head, the intermediate zone connecting said upper zone to said lower zone and having a diameter which is tapered therebetween, and the lower zone being substantially cylindrical and having a diameter substantially equal to an inner diameter of said lower end of said delivery head.

6. A device as in claim 1, wherein said flow is conveyed through said ring-shaped passage in a substantially angled manner with respect to a direction of outlet flow of said fluid products from said delivery nozzles.

7. A device as in claim 1, wherein said ring-shaped passage is between 1 mm and 10 mm wide.

8. A device as in claim 1, wherein the distance between a base of said ring-shaped chamber and said lower end of said delivery head is between 0.1 mm and 1 mm.

9. A device as in claim 1, wherein for each of said delivery nozzles, the distance between a lower end of the delivery nozzle and said lower end of said delivery head is between zero and about 4 mm.

10. A device as in claim 1, wherein said sensors are arranged in said ring-shaped chamber.

11. A device as in claim 1, wherein a pipe is able to introduce said flow of air mixed with steam or with at least a solvent into said ring-shaped chamber taking said steam or solvent from said tank.

12. A method for preventing the exsiccation of fluid products in a delivery head of a dispensing machine for said fluid products, wherein said delivery head is provided with one or more delivery nozzles, the method comprising:

generating a flow of air mixed with steam or with at least a solvent;

conveying said flow into a ring-shaped chamber which extends around said delivery head, said ring-shaped chamber being defined by a ring-shaped element arranged substantially coaxial with said delivery head, said ring-shaped chamber having a central hole which contains at least a portion of said delivery head, said flow being conveyed through a ring-shaped passage between said ring-shaped chamber and a lower end of said delivery head, said ring-shaped passage surrounding a perimeter of said lower end of said delivery head;

said flow thereby creating in a zone underneath said delivery nozzles into which said fluid is dispensed from said nozzles; a determinate atmosphere different from the atmosphere in the environment where said dispensing machine is to be found during use;

detecting a temperature and a relative humidity or solvent content of said flow by means of sensors arranged in proximity with said delivery head; and regulating, by use of a regulation mechanism, the temperature and the relative humidity or solvent content of said flow according to the values detected by said sensors in order to maintain the temperature and relative humidity or solvent content of said flow within a set of pre-determined values.

* * * * *